US005848712A

United States Patent [19]

Weir

[11] Patent Number: 5,848,712

[45] Date of Patent: Dec. 15, 1998

[54] ROTATABLE TRAY WITH ELEVATED SERVING SURFACE

[76] Inventor: Ralph J. Weir, 8954 Heathwood Cir., Niles, Ill. 60714

[21] Appl. No.: 728,999

[22] Filed: Oct. 10, 1996

[51] Int. Cl.[6] ..... A47F 5/00

[52] U.S. Cl. ..... 211/107; 108/50.12; 211/144; 211/133.4

[58] Field of Search ..... 211/86, 88, 99, 211/113, 126, 107, 131, 163, 144, 129.1, 133.4, 133.6; 108/150, 151, 50.12

[56] References Cited

U.S. PATENT DOCUMENTS

| | | | |
|---|---|---|---|
| 62,903 | 3/1867 | Stewart | 211/144 |
| 668,753 | 12/1901 | Storrs | 211/144 |
| 2,195,366 | 3/1940 | Haigh | 248/226 |
| 3,434,484 | 3/1969 | Dilullo | 108/50.12 X |
| 3,624,732 | 11/1971 | Bowden | 108/50.12 |
| 5,335,803 | 8/1994 | O'Brien et al. | 211/163 |
| 5,522,514 | 6/1996 | Robinson | 211/107 X |

*Primary Examiner*—Robert W. Gibson, Jr.
*Attorney, Agent, or Firm*—Burkhart & Burkhart; Anne K. Burkhart; Patrick N. Burkhart

[57] ABSTRACT

A serving tray adapted for use with a table having a table surface. The tray includes a generally planar tray member with an aperture located in a central portion thereof. An elevational member is affixed to, and extends downwardly from, the tray member. The elevational member includes a central bore in substantially coaxial alignment with the aperture in the tray member, and is adapted and constructed to be secured to the table surface. The elevational member is of sufficient height to allow relatively unimpeded use of the table surface beneath the tray member when the elevational member is secured to the table surface. The aperture and the bore can be adapted to receive an umbrella pole, and both the tray and the elevational member are rotatable around the umbrella pole. This can be accomplished, where the table surface has a center hole adapted and constructed to receive an umbrella pole, by providing the central bore of the elevational member with a diameter that is substantially equal to the diameter of the center hole. In order to mount the tray when an umbrella is not in use, the tray can be provided with an adapter plug to secure the elevational member to the table surface. In an embodiment, the adapter plug includes a first cylindrical portion having an outside diameter substantially equal to the diameter of the bore in the elevational member, and a second cylindrical portion, coaxial with and connected to the first cylindrical portion, having an outside diameter substantially equal to the diameter of the center hole in the table surface. A generally cylindrical flange portion connects and separates the first and second cylindrical portions, and has a diameter greater than the diameter of the center hole in the table surface.

12 Claims, 4 Drawing Sheets

ROTATABLE TRAY WITH ELEVATED SERVING SURFACE

BACKGROUND OF THE INVENTION

1. Technical Field

The present invention relates to serving trays, and specifically to auxiliary serving trays associated with dining tables.

2. Background Art

Outdoor dining furniture, once the purview of posh Parisian patisseries, can now be found on virtually every suburban deck or patio. In order to enhance the ambiance of dining alfresco, outdoor tables have been provided with umbrellas to shield diners from intense heat and light sprinkles. Such umbrellas are frequently mounted on rather substantial poles, which extend through a central hole the surface of the table and into a base member or hole beneath the table.

While patio table umbrellas have no doubt saved untold millions of picnickers from excessive exposure to ultraviolet light, they are not without their own drawbacks. For example, placement of a large pole in the center of the dinner table cuts down on the amount of space available for dining accouterments. Given that outdoor dining generally requires more than the usual complement of condiments, serving dishes, utensils, et cetera, any reduction of available space is problematic. Furthermore, the central umbrella pole impedes the ability of diners who are not contortionists to pass items to one another without substantial effort.

It may also be desirable under some circumstances to use outdoor dining tables without umbrellas. For instance, on a shaded terrazzo, in a sheltered area beneath a pergola, or on a starlit night, the dining experience may be enhanced by having unimpeded overhead views. Nonetheless, the concerns of space and access are no less a factor when the umbrella is not in use.

As may be expected, some of these difficulties have been the subject of much inventive effort, some of which has made its way into the patent literature. Typical of these patents is U.S. Pat. No. 5,335,803 to O'Brien et al. The O'Brien patent is directed to a rotatable food tray for an outdoor patio table having an umbrella. The food tray includes a centrally disposed aperture to accommodate the support post of the umbrella. A base support member is placed beneath the food tray for free rotation of the tray in relation to the table. The support member can be placed directly on the eating surface, or alternatively placed at any position along the length of the umbrella support post by the use of extension posts or support pins associated with the umbrella post.

Although the tray of the O'Brien patent addresses some of the problems noted above, in so doing it also introduces some additional difficulties. For example, when the tray is placed directly on the eating surface, it actually reduces the already-scarce available dining space. Furthermore, mounting the food tray such that it does not reduce dining surface area not only requires the presence of an umbrella having a post, but necessitates the use of a special umbrella to accommodate support pins, or else additional fixed support members.

It can therefore be seen that there exists a need for a simple and effective apparatus that will increase the available surface area of an outdoor dining table while enhancing the convenience of diners.

SUMMARY OF THE INVENTION

The present invention provides a revolving tray that increases the working area of an "outdoor" dining table without taking up significant surface area of the table itself. The tray includes a unitary tray member and elevational member that can be installed with or without an umbrella. Where the tray is used with an umbrella, the umbrella pole is simply passed through the tray while installing the umbrella into the table in a normal manner. Where the tray is used without an umbrella, the tray is simply mounted on a plug inserted into the table center hole normally used for the umbrella.

The tray elevates needed items, such as condiments, utensils, and the like, removing them from the eating surface, while providing easy access to the items by tray rotation. The relatively simple design requires no special modification of the umbrella pole or table, and is readily and easily installed in any table with a conventional center hole. Its simple construction lends itself to fabrication from a host of materials (metals, plastics, etc.) in a variety of shapes and colors.

Disclosed is a serving tray adapted for use with a table having a table surface. The tray includes a generally planar tray member with an aperture located in a central portion thereof. An elevational member is affixed to, and extends downwardly from, the tray member. The elevational member includes a central bore in substantially coaxial alignment with the aperture in the tray member, and is adapted and constructed to be secured to the table surface. The elevational member is of sufficient height to allow relatively unimpeded use of the table surface beneath the tray member when the elevational member is secured to the table surface. The aperture and the bore can be adapted to receive an umbrella pole. With the umbrella pole inserted in the tray, both the tray and the elevational member are rotationally secured to the table. This can be accomplished, where the table surface has a center hole adapted and constructed to receive an umbrella pole, by providing the central bore of the elevational member with a diameter that is substantially equal to the diameter of the center hole. The tray can be provided with a retaining lip extending upwardly from, and substantially surrounding the periphery of, the tray member.

In order to mount the tray when an umbrella is not in use, the tray can be provided with an adapter plug to secure the elevational member to the table surface. In an embodiment, the adapter plug includes a first cylindrical portion having an outside diameter substantially equal to the diameter of the bore in the elevational member, and a second cylindrical portion, coaxial with and connected to the first cylindrical portion, having an outside diameter substantially equal to the diameter of the center hole in the table surface. A generally cylindrical flange portion connects and separates the first and second cylindrical portions, and has a diameter greater than the diameter of the center hole in the table surface.

In another embodiment, an adapter plug includes a first cylindrical portion having an outside diameter substantially equal to the diameter of the bore in the elevating member. A second cylindrical portion, coaxial with and connected to the first cylindrical portion, has a threaded outer surface. A generally cylindrical flange portion, connected to and separating the first and second cylindrical portions, has a diameter greater than the diameter of the center hole in the table surface A threaded securing member is provided with a central opening sized and threaded for securing engagement with the threaded outer surface of the second cylindrical portion.

Other advantageous features of the present invention will become apparent upon reference to the accompanying description when taken in conjunction with the following drawings.

DETAILED DESCRIPTION OF THE PREFERRED EMBODIMENTS

Figure 1:
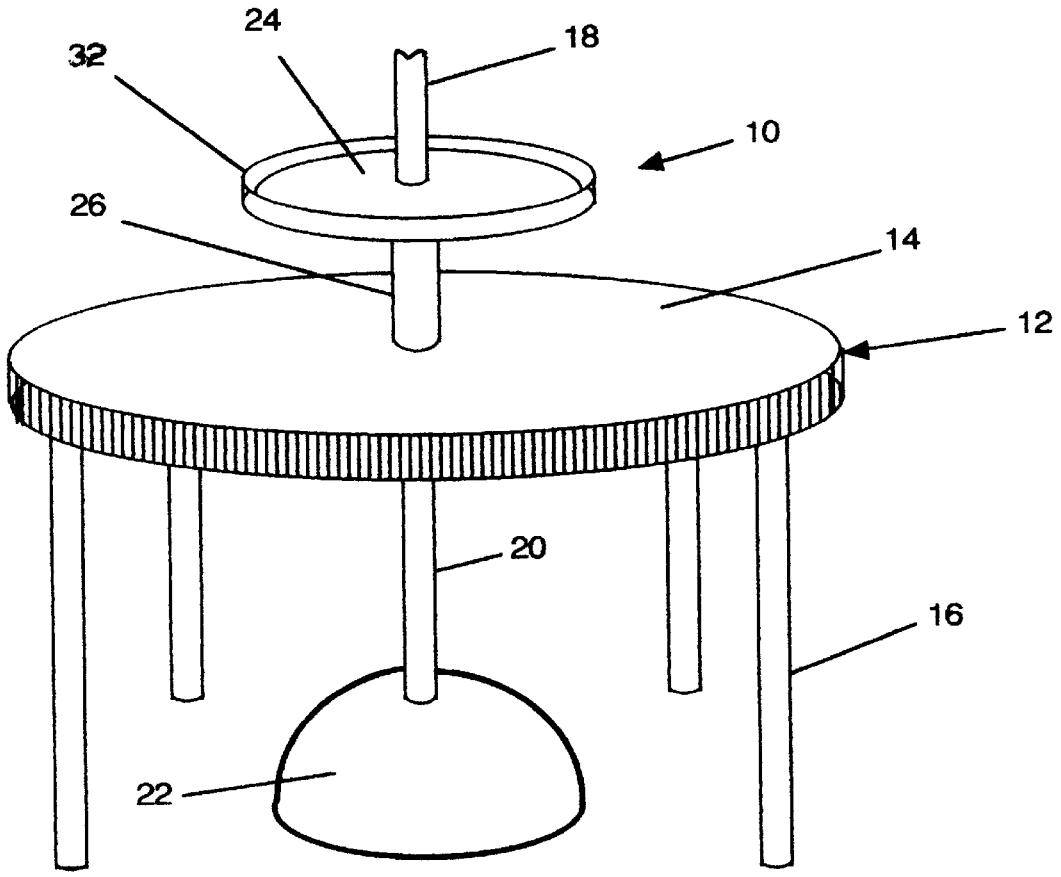
FIG. 1 illustrates a perspective view of a serving tray in conjunction with a table.
Figure 2:
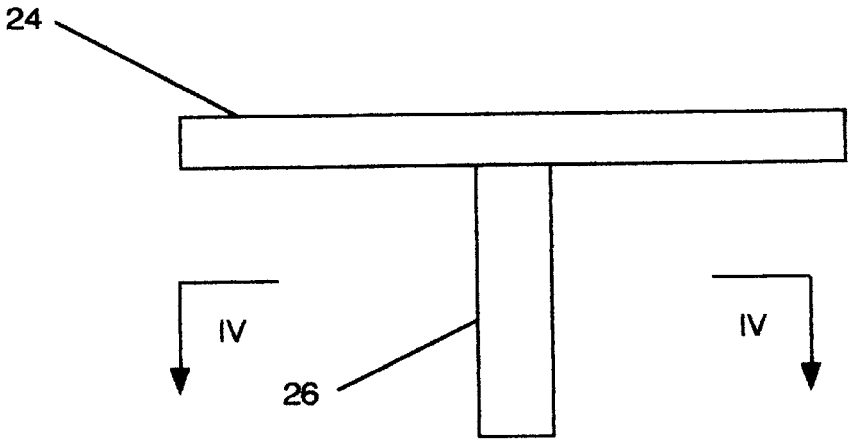
FIG. 2 illustrates a front elevational view of a serving tray.
Figure 3:
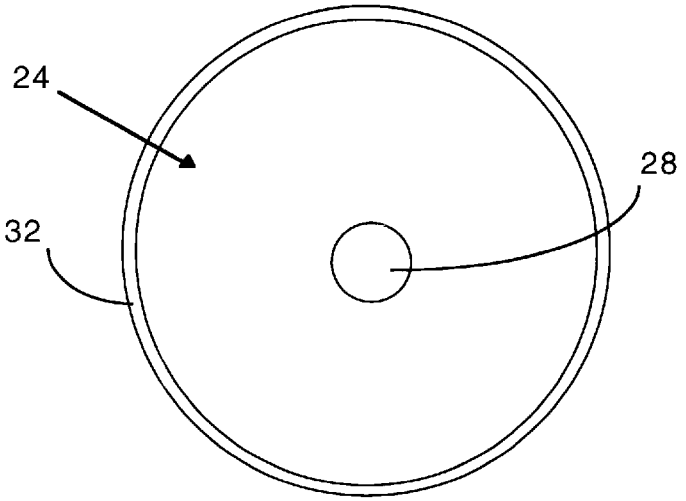
FIG. 3 illustrates a plan view of a serving tray.
Figure 4:
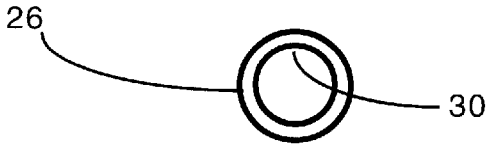
FIG. 4 illustrates a section taken generally along lines IV—IV of FIG. 2.

A serving tray 10, shown in FIG. 1, is adapted for use with an outdoor dining table 12. The table 12 includes a table surface 14 supported at a predetermined height above the ground or deck surface by one or more legs 16. An umbrella pole 18 extends through a center hole (not shown in FIG. 1) in the table surface 14, while a lower portion 20 of the umbrella pole 18 is inserted into a support base 22 beneath the table 12. The support base 22 is of sufficient mass to lend stability to an umbrella (not shown) mounted at the top of the umbrella pole 18.

As seen in FIGS. 1–4, the tray 10 includes a tray member 24 secured to an elevational member 26. The tray member 24 and elevational member 26 can be unitary, or may be secured to one another via a screw connection, gluing, or any other suitable mode of attachment. The tray member 24 includes a central aperture 28 that is in substantially coaxial alignment with a center bore 30 of the elevational member 26. Although the tray member 24 and elevational member 26 are shown as being circular and cylindrical, respectively, it is contemplated that they could be manufactured in any suitable shape for aesthetic purposes. A retaining lip 32 can also be provided along the periphery of the tray member 24 in order to better secure items placed on the surface of the tray member 24.

Figure 5:
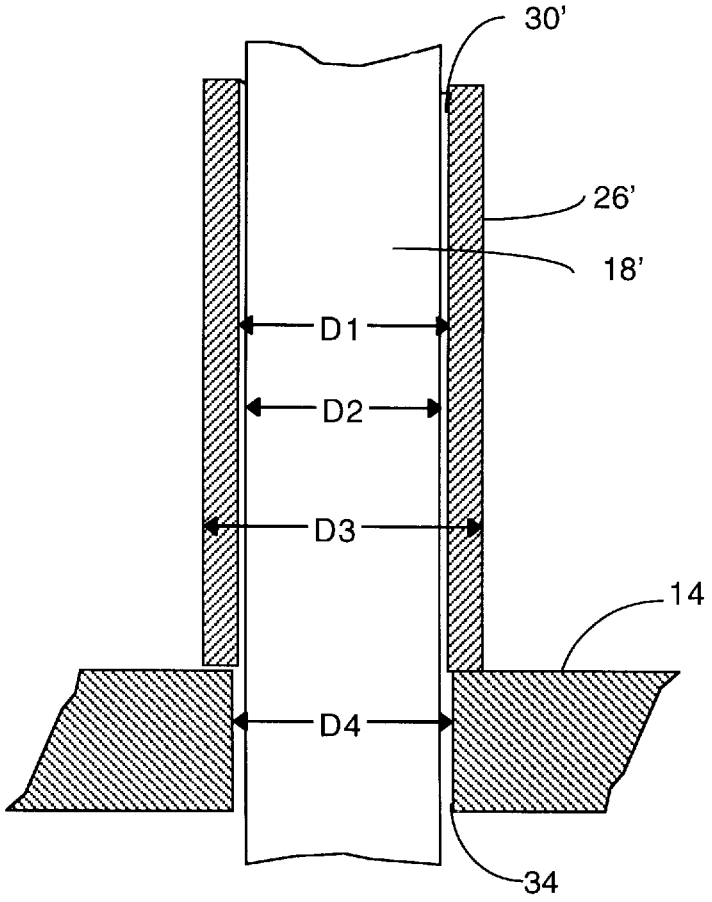
FIG. 5 illustrates a sectional view, partially broken away, of a tray secured to a table.

The present invention contemplates a variety of modes of securing the tray to the table surface. As shown in FIG. 5, an elevational member 26' has an central bore 30' having an inner diameter D1 that is slightly greater than an inner diameter D2 of an umbrella pole 18'. The elevational member 26' has an outer diameter D3 that is larger than a diameter D4 of a center hole 34 in a table surface 14'. In this embodiment, the relative diameters allow the elevational member 26' to support the tray (not shown) against the table surface 14', while allowing enough clearance to permit simultaneous rotation of the elevational member 26' and tray member about the umbrella pole 18'.

Figure 6:
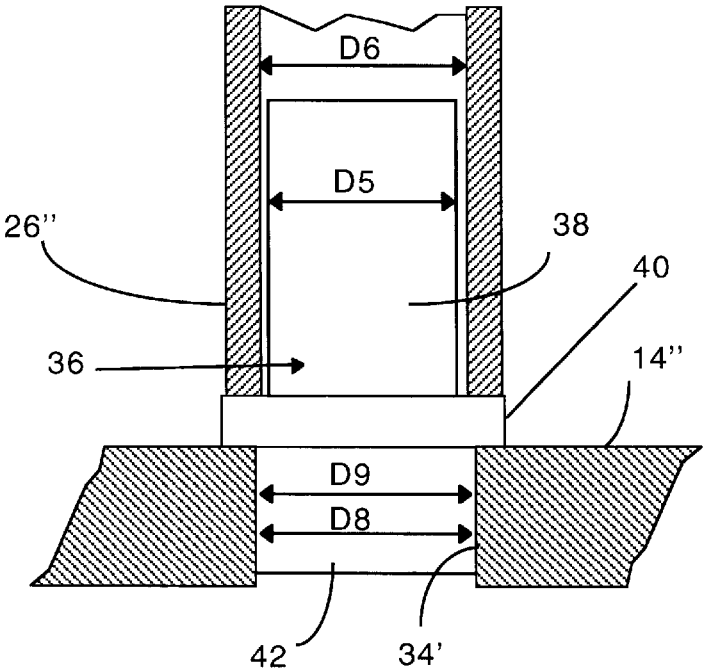
FIG. 6 illustrates a sectional view, partially broken away, of a tray secured to a table with an adapter plug.
Figure 7:
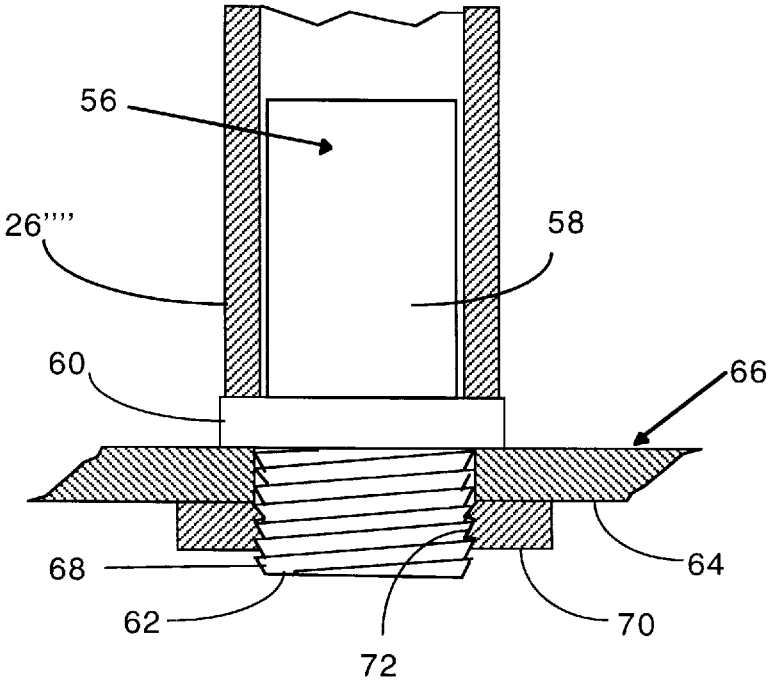
FIG. 7 illustrates a sectional view, partially broken away, of a tray secured to a table with an adapter plug.

FIGS. 6 and 7 show alternative mounting arrangements which eliminate the need for a tray-supporting umbrella pole. In FIG. 6, the elevational member 26" is secured to the table surface 14" by an adapter plug 36. The adapter plug 36 includes a first cylindrical portion 38 having an outer diameter D5 that is slightly smaller than an inner diameter D6 of the elevational member 26". The first cylindrical portion 38 is of sufficient height to provide vertical support to the elevational member 26". A flange member 40 is connected to the first cylindrical portion 38, and has an outer diameter D7 that is larger than a diameter D8 of a center hole 34' in a table surface 14". The flange portion 40 is connected to the first cylindrical portion 38 and a second cylindrical portion 42, and acts to physically separate the first and second cylindrical portions from one another while providing a connection therebetween. The second cylindrical portion 42 has a diameter D9 that is adapted to fit snugly and securely within the center hole 34' in a table surface 14". Thus, the elevational member 26" and associated tray member are free to rotate about the first cylindrical portion 38, while being secured to the table 14" via the second cylindrical portion 42 within the center hole 34'.

Outdoor dining tables are frequently constructed with table tops fabricated from steel mesh or glass. Such table tops are therefore relatively thin, and trays attached in accordance with the present invention may therefore require additional support. FIG. 7 shows an adapter plug 56 designed to give such support. The adapter plug 56 includes a first cylindrical portion 58 having an outer diameter slightly less than the inner diameter of an elevational member 26'". A flange portion 60, similar to the cylindrical portion described with reference to FIG. 6, connects the first cylindrical portion 58 to a second cylindrical portion 62. The second cylindrical portion 62 extends beyond the lower surface 64 of the table top 66, and includes a threaded outer surface 68. A threaded securing member 70 includes a central opening 72 that is sized and threaded for securing engagement with the threaded outer surface 68 of the second cylindrical portion 62. In use, the second cylindrical portion 62 is inserted through the table top 66, and the threaded securing member 70 is engaged with the threaded outer surface 68 so that the table top 66 is held tightly between the flange portion 60 and the securing member 70. This provides a stable base for the tray, which is secured to the table top by placement of the elevational member 26"" over the first cylindrical portion 58.

The forgoing description is capable of wide variation within the scope of the present invention. For instance, it is contemplated that the tray member could be formed in various shapes (e.g., sports equipment shapes such as football helmets, commercial logos, novelty shapes), or may be used as a medium for advertising or other indicia. Further, it is contemplated that the height of the tray in use could be adjusted by cutting of or otherwise removing portions off the bottom of the elevational member.

Although the present invention has been described with reference to a specific embodiment, those of skill in the art will recognize that changes may be made thereto without departing from the scope and spirit of the invention as set forth in the appended claims.

I claim:

1. A unitary serving tray adapted for use with a table having a table surface with a center hole adapted and constructed to receive an umbrella pole, the tray comprising the following:

a generally planar tray member;

an aperture located in a central portion of the tray member; and an elevational member affixed to and extending downwardly from the tray member, the elevational member including a central bore in substantially coaxial alignment with the aperture in the tray member and being adapted and constructed to be secured in direct contact with the table surface;

wherein the elevational member is of sufficient height to allow relatively unimpeded use of the table surface beneath the tray member when the elevational member is secured to the table surface.

2. A unitary serving tray in accordance with claim 1, wherein the aperture and the bore are adapted to receive an umbrella pole.

3. A unitary serving tray in accordance with claim 2, wherein the tray and the elevational member are rotatable around the umbrella pole.

4. A unitary serving tray in accordance with claim 2, wherein the central bore of the elevational member has a diameter that is substantially equal to the diameter of the center hole in the table surface.

5. A unitary serving tray in accordance with claim 2, further comprising an adapter plug including the following:

a first cylindrical portion having an outside diameter substantially equal to the diameter of the bore in the elevating member;

a second cylindrical portion, coaxial with and connected to the first cylindrical portion, having an outside diameter substantially equal to the diameter of the center hole in the table surface; and a generally cylindrical flange portion, connected to and separating the first and second cylindrical portions, having a diameter greater than the diameter of the center hole in the table surface.

6. A unitary serving tray in accordance with claim 2, wherein the table surface has a center hole adapted and constructed to receive an umbrella pole, and further comprising an adapter plug including the following:

a first cylindrical portion having an outside diameter substantially equal to the diameter of the bore in the elevating member;

a second cylindrical portion, coaxial with and connected to the first cylindrical portion, having a threaded outer surface;

a generally cylindrical flange portion, connected to and separating the first and second cylindrical portions, having a diameter greater than the diameter of the center hole in the table surface; and a threaded securing member having a central opening, the central opening being sized and threaded for securing engagement with the threaded outer surface of the second cylindrical portion.

7. A unitary serving tray in accordance with claim 1, wherein the tray member is circular.

8. A unitary serving tray in accordance with claim 1, wherein the elevational member is substantially cylindrical.

9. A unitary serving tray in accordance with claim 1, further comprising:

a retaining lip secured to the tray member, the retaining lip extending upwardly from, and substantially surrounding the periphery of, the tray member.

10. A unitary serving tray adapted for use with a table having a table surface, the tray consisting essentially of the following:

a generally circular tray member including a generally circular aperture located in a central portion thereof;

a generally cylindrical elevational member affixed to and extending downwardly from the tray member, the elevational member including a generally cylindrical central bore extending the entire length of the elevational member in substantially coaxial alignment with the aperture in the tray member; and securing means for securing the tray member to the table surface at such an elevation to allow relatively unimpeded use of the table surface beneath the tray member when the elevational member is secured to the table surface.

11. A method of providing additional serving area to a table having a center hole therein with a generally vertical pole member extending upwardly through the center hole, the method comprising the following steps:

providing a generally planar tray member;

providing an aperture located in a central portion of the tray member;

providing an elevational member affixed to, unitary with, and extending downwardly from the tray member, the elevational member including a central bore substantially coaxial alignment with the aperture in the tray member;

positioning the elevational member so that the vertical pole member extends through the central bore of the elevational member; and securing the elevational member directly to the table surface such that the tray member is held above the table surface by the elevational member at a height sufficient to allow relatively unimpeded use of the table surface beneath the tray member.

12. A method according to claim 11, further comprising the step of adjusting the height of the tray by removing a bottom part of the elevational member.

* * * * *